US010674877B1

(12) United States Patent
Smith

(10) Patent No.: US 10,674,877 B1
(45) Date of Patent: Jun. 9, 2020

(54) BACK SCRUBBER

(71) Applicant: Cassandra Smith, Seattle, WA (US)

(72) Inventor: Cassandra Smith, Seattle, WA (US)

( * ) Notice: Subject to any disclaimer, the term of this patent is extended or adjusted under 35 U.S.C. 154(b) by 0 days.

(21) Appl. No.: 16/267,490

(22) Filed: Feb. 5, 2019

(51) Int. Cl.
*A47K 7/02* (2006.01)
*A47K 7/04* (2006.01)
*A46B 5/00* (2006.01)

(52) U.S. Cl.
CPC ..... *A47K 7/028* (2013.01); *A47K 7/043* (2013.01); *A46B 5/0054* (2013.01)

(58) Field of Classification Search
CPC ..... A47K 7/022; A47K 7/028; A47K 7/04; A47K 7/043; A47K 7/06; A47K 7/08; A46B 5/0054; A46B 5/0075; A46B 5/0079
USPC ..... 401/6, 99, 201; 15/144.4; 16/429
See application file for complete search history.

(56) References Cited

U.S. PATENT DOCUMENTS 5,360,111 A 11/1994 Arispe
5,568,669 A 10/1996 Godown
5,823,206 A 10/1998 Mapleback
6,523,550 B2 * 2/2003 McCormick ..... A45D 34/04 132/320
6,550,996 B1 4/2003 Rayfield
D490,565 S 5/2004 Ali
8,646,142 B2 2/2014 Ferrara
9,009,920 B1 * 4/2015 Ramsey ..... B25G 1/04 16/429
2013/0125325 A1 5/2013 Brancovsky

FOREIGN PATENT DOCUMENTS

WO 2004069022 8/2004

* cited by examiner

*Primary Examiner* — David J Walczak
*Assistant Examiner* — Joshua R Wiljanen

(57) ABSTRACT

The back scrubber is a hygienic device. The back scrubber is adapted for use with a person. The back scrubber is configured for use in bathing. The back scrubber is configured for use with soap. The back scrubber extends the reach of the person such that soap may be applied to otherwise inaccessible locations of the person. The back scrubber comprises a head, a handle, and a control system. The control system is installed in the handle. The head attaches to the handle. The head contains the soap. The handle extends the reach of the person. The control system adjusts the overall length of the handle.

16 Claims, 6 Drawing Sheets

BACK SCRUBBER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical or veterinary science including bathing devices for hygienic purposes, more specifically, a device for massaging the skin by brushing that is not otherwise provided for.

SUMMARY OF INVENTION

The back scrubber is a hygienic device. The back scrubber is adapted for use with a person. The back scrubber is configured for use in bathing. The back scrubber is configured for use with soap. The back scrubber extends the reach of the person such that soap may be applied to otherwise inaccessible locations of the person. The back scrubber comprises a head, a handle, and a control system. The control system is installed in the handle. The head attaches to the handle. The head contains the soap. The handle extends the reach of the person. The control system adjusts the overall length of the handle.

These together with additional objects, features and advantages of the back scrubber will be readily apparent to those of ordinary skill in the art upon reading the following detailed description of the presently preferred, but nonetheless illustrative, embodiments when taken in conjunction with the accompanying drawings.

In this respect, before explaining the current embodiments of the back scrubber in detail, it is to be understood that the back scrubber is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the back scrubber.

It is therefore important that the claims be regarded as including such equivalent construction insofar as they do not depart from the spirit and scope of the back scrubber. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
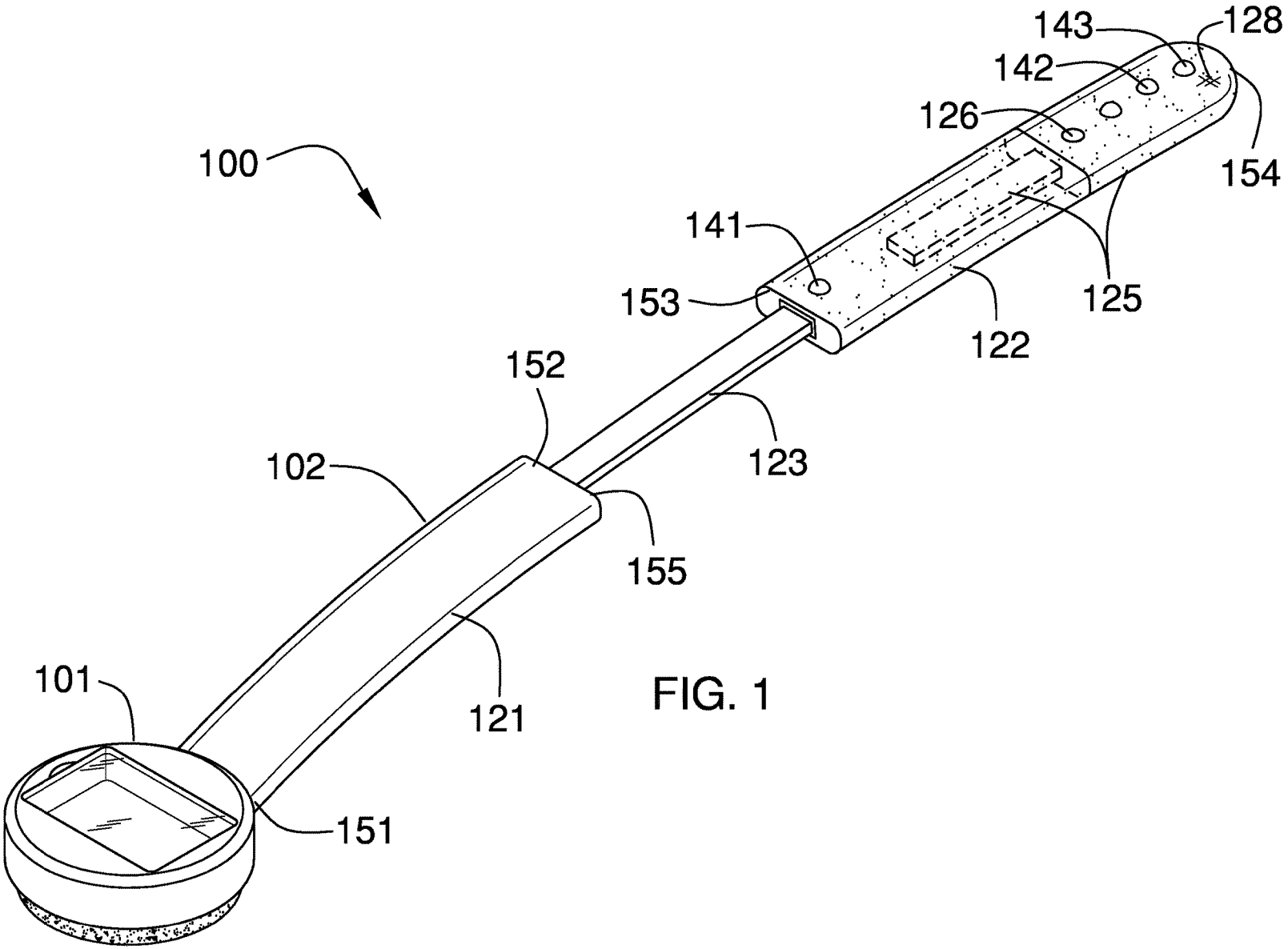
FIG. 1 is an extended perspective view of an embodiment of the disclosure.
Figure 2:
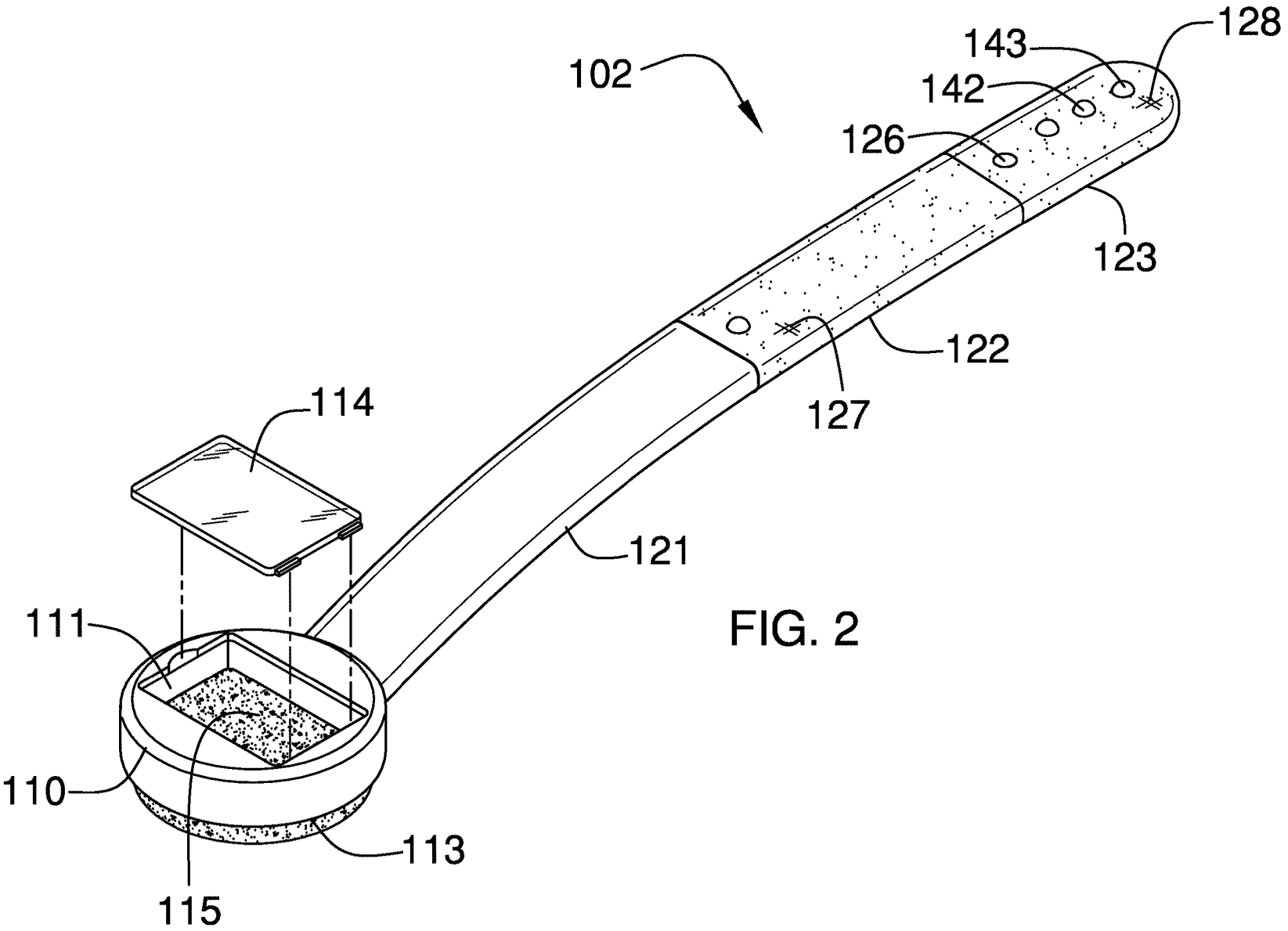
FIG. 2 is a retracted perspective view of an embodiment of the disclosure.
Figure 3:
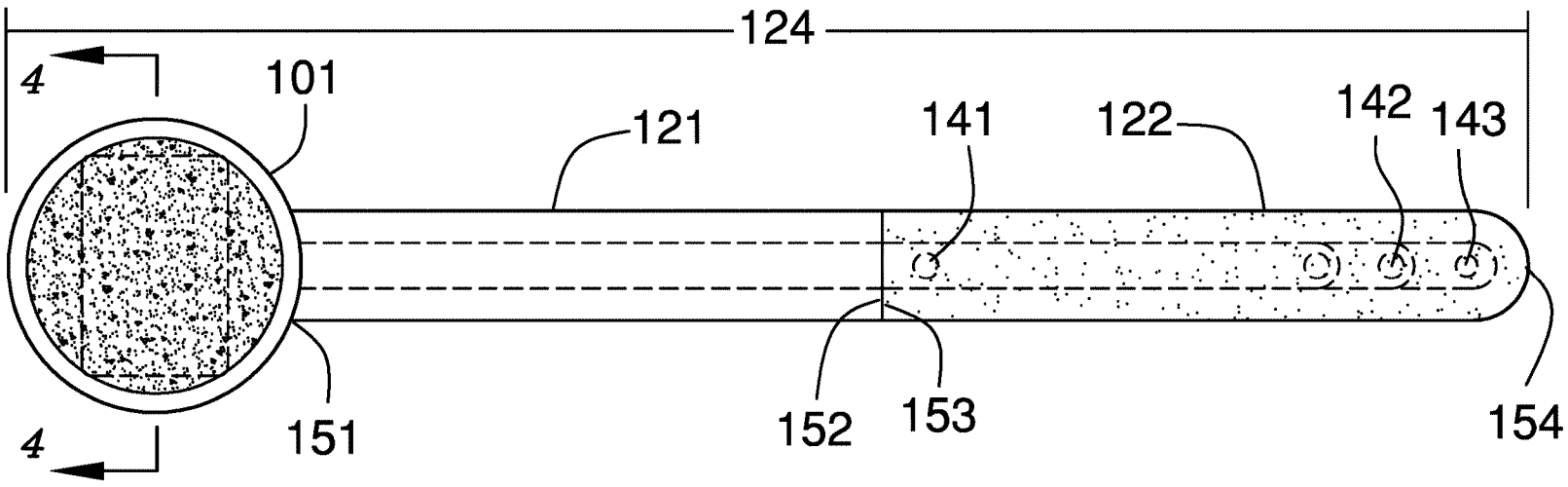
FIG. 3 is a bottom view of an embodiment of the disclosure.
Figure 4:
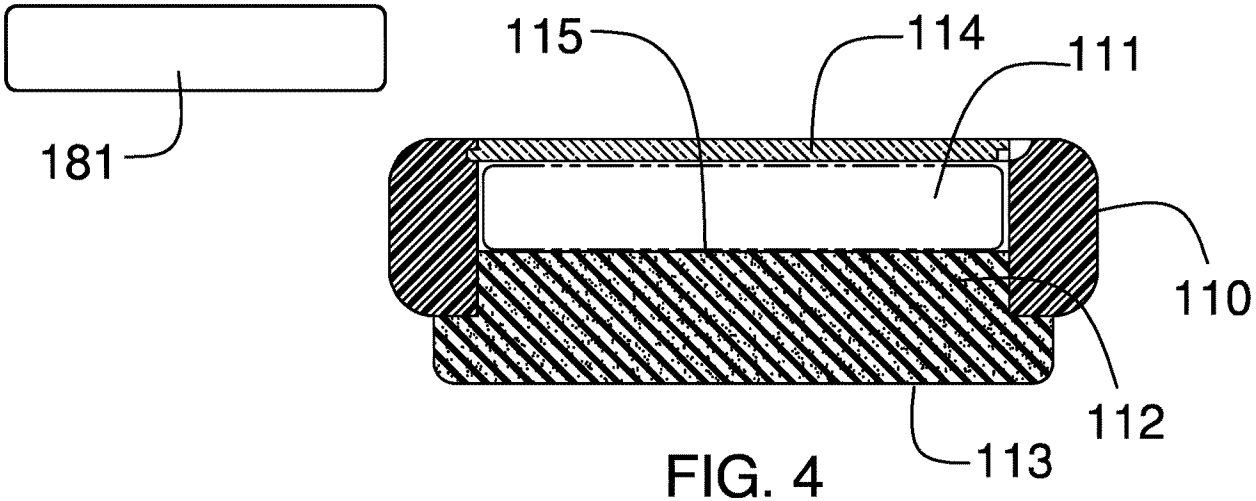
FIG. 4 is a cross-sectional view of an embodiment of the disclosure across 4-4 as shown in FIG. 3.
Figure 5:
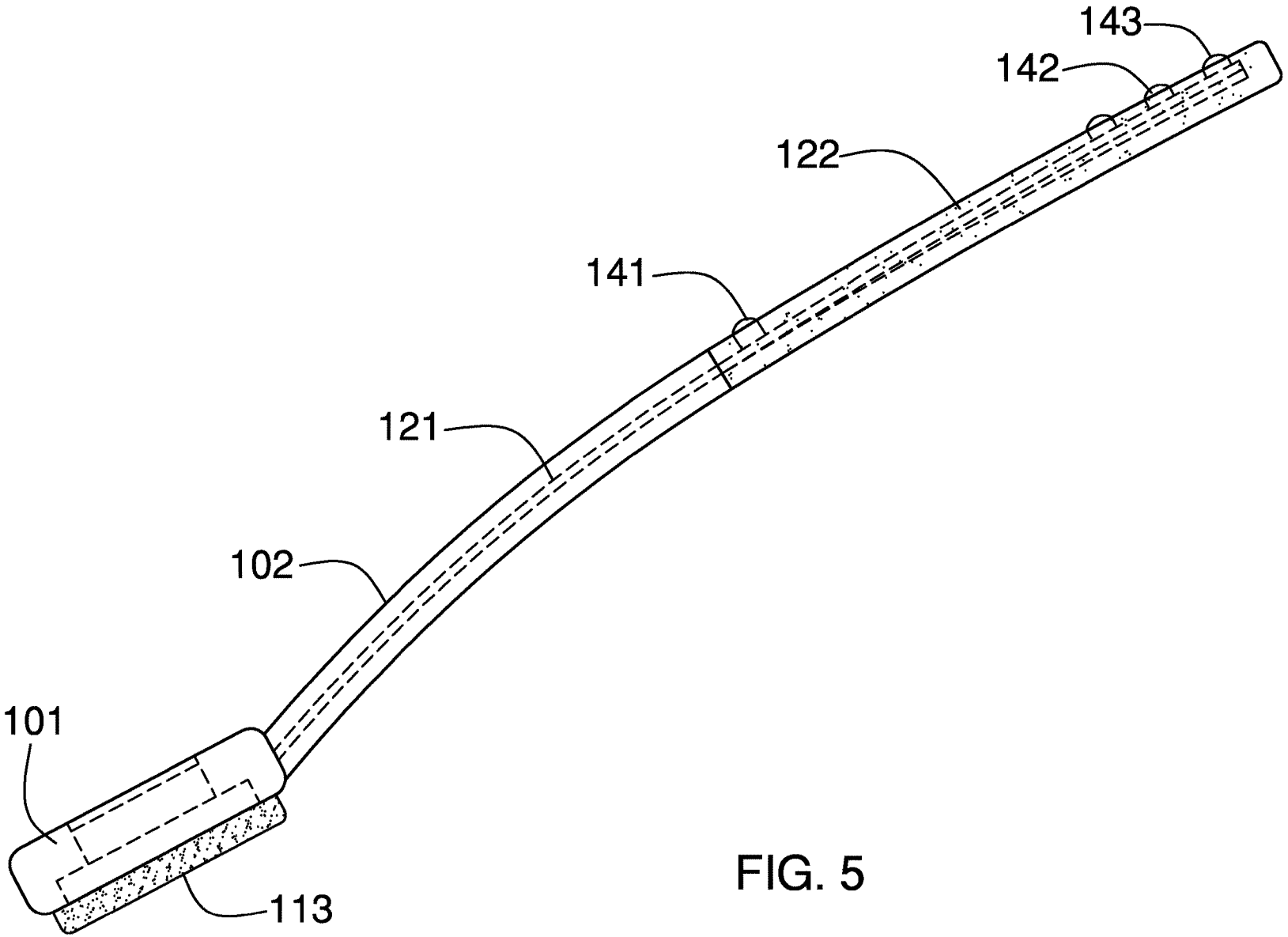
FIG. 5 is a side view of an embodiment of the disclosure.
Figure 6:
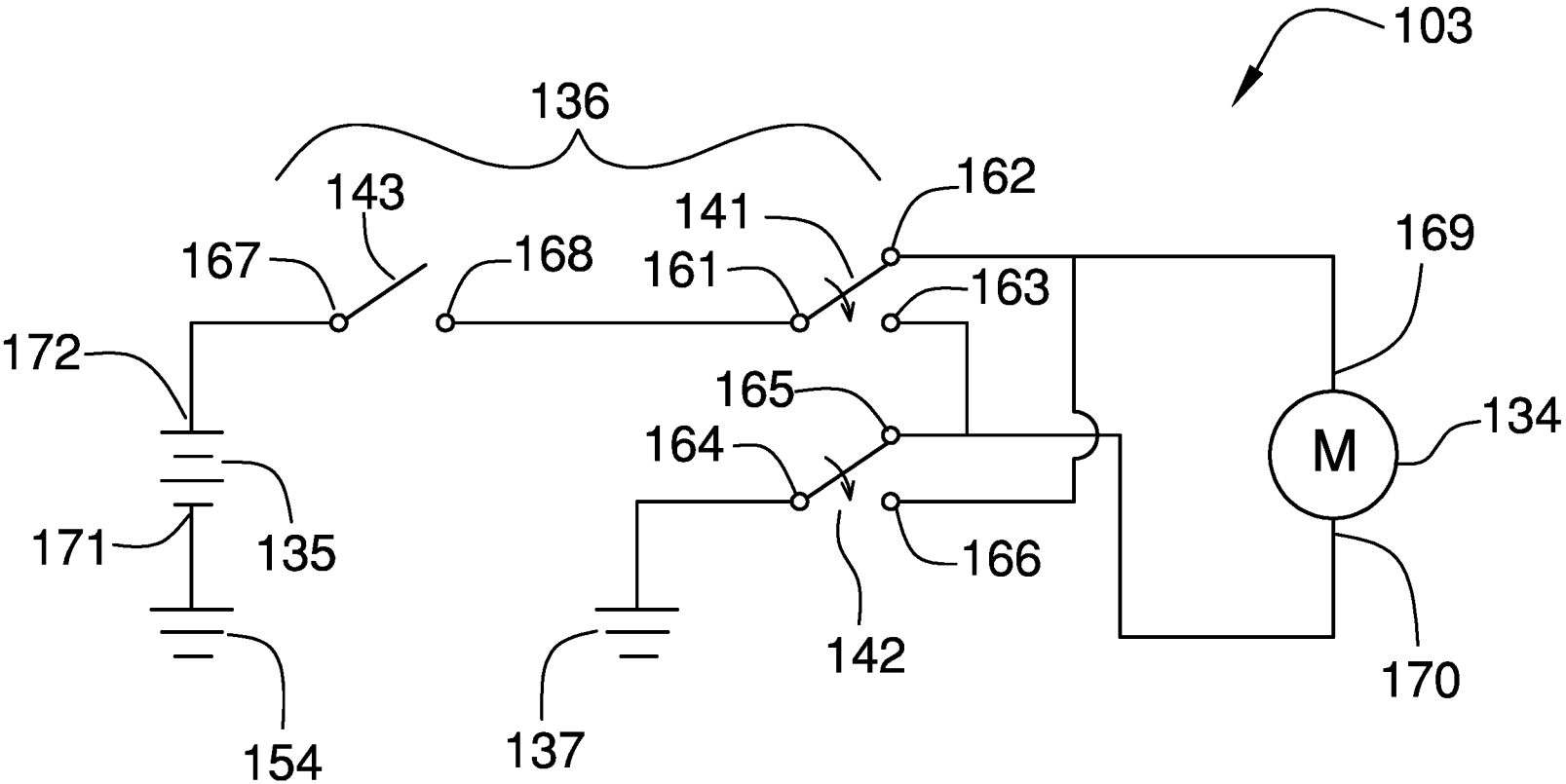
FIG. 6 is a schematic view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The back scrubber 100 (hereinafter invention) is a hygienic device. The invention 100 is adapted for use with a person. The invention 100 is configured for use in bathing. The invention 100 is configured for use with soap 181. Soap 181 is discussed in greater detail elsewhere in this disclosure. The invention 100 extends the reach of the person such that soap 181 may be applied to otherwise inaccessible locations of the person. The invention 100 comprises a head 101, a handle 102, and a control system 103. The control system 103 is installed in the handle 102. The head 101 attaches to the handle 102. The head 101 contains the soap 181. The handle 102 extends the reach of the person. The control system 103 adjusts the overall reach 124 of the handle 102.

The head 101 is the cleansing structure of the invention 100. The head 101 is used to apply soap 181 during bathing. The head 101 attaches to the first end 151 of the first arm 121 of the handle 102. The head 101 comprises a plate 110, a first cavity 111, a second cavity 112, a sponge 113, a lid 114, and a foraminous divider 115.

The plate 110 is the master structure of the head 101. The plate 110 is a structure that is formed with a uniform thickness. The first cavity 111 is a negative space that is formed in the plate 110. The first cavity 111 is formed in the shape of a rectangular block. The first cavity 111 is sized to receive a bar of soap 181. The lid 114 is a barrier that encloses the first cavity 111 after the soap 181 has been installed in the first cavity 111. Methods to form a lid 114 for a contained space are well-known and documented in the mechanical arts.

The second cavity 112 is a negative space that is formed in the plate 110. The second cavity 112 is formed in the face of the plate 110 that is distal from the face of the plate 110 that received the first cavity 111. The second cavity 112 is formed in a shape that is sized to receive the sponge 113. The sponge 113 is a cleansing device that is used to apply soap 181 during the bathing process. The sponge 113 is discussed in greater detail elsewhere in this disclosure. The sponge 113 is a well-known and documented structure.

The foraminous divider 115 is a foraminous surface that separates the first cavity 111 from the second cavity 112. The foraminous divider 115 allows water to pass between the first cavity 111 and the second cavity 112 such that the soap 181 will be dispensed during the bathing process.

The handle 102 is an extension device that extends the reach of the person during bathing. The handle 102 is adjustable in length. The handle 102 comprises a first arm 121, a second arm 122, and a tenon 123. The first arm 121 is further defined with a first end 151 and a second end 152. The second arm 122 is further defined with a third end 153 and a fourth end 154. The tenon 123 is further defined with a fifth end 155 and a sixth end 156. The handle 102 is further defined with a reach 124. The reach 124 refers to the span of distance from the fourth end 154 of the second arm 122 to the point of the head 101 that is distal from the first end 151 of the first arm 121.

The first arm 121 is a shaft structure that attaches the second arm 122 to the head 101. The head 101 attaches to the first end 151 of the first arm 121. The second arm 122 is a hollow shaft structure that forms the portion of the handle 102 that is distal from the head 101. The tenon 123 is an inert mechanical structure that attaches the first arm 121 to the second arm 122. The fifth end 155 of the tenon 123 attaches to the second end 152 of the first arm 121. The sixth end 156 of the tenon 123 is inserted into the third end 153 of the second arm 122. The sixth end 156 of the tenon 123 attaches to the U grip 133 of the control system 103. The U grip 133 is discussed in greater detail elsewhere in this disclosure.

The control system 103 is an electromechanical device that is used to adjust the span of the reach 124 of the handle 102. The control system 103 is installed in the hollow second arm 122 of the handle 102. The control system 103 comprises a worm drive 131, a transfer ring 132, a U grip 133, a motor 134, a battery 135, a plurality of switches 136, and an electrical ground 137. The motor 134 is further defined with a ninth lead 169 and an tenth lead 170. The battery 135 is further defined with an anode 171 and a cathode 172.

The worm drive 131 is a cylindrical structure that is formed with an exterior screw thread 191. The transfer ring 132 is a nut like object that is formed with an interior screw thread 192 that matches the exterior screw thread 191 of the worm drive 131. The transfer ring 132 is screwed onto the worm drive 131 in such a manner that the transfer ring 132 will travel along the direction of the center axis of the worm drive 131 when the worm drive 131 is rotated around its center axis. Methods to design and use a worm drive 131 are well known and documented in the mechanical arts.

Figure 7:
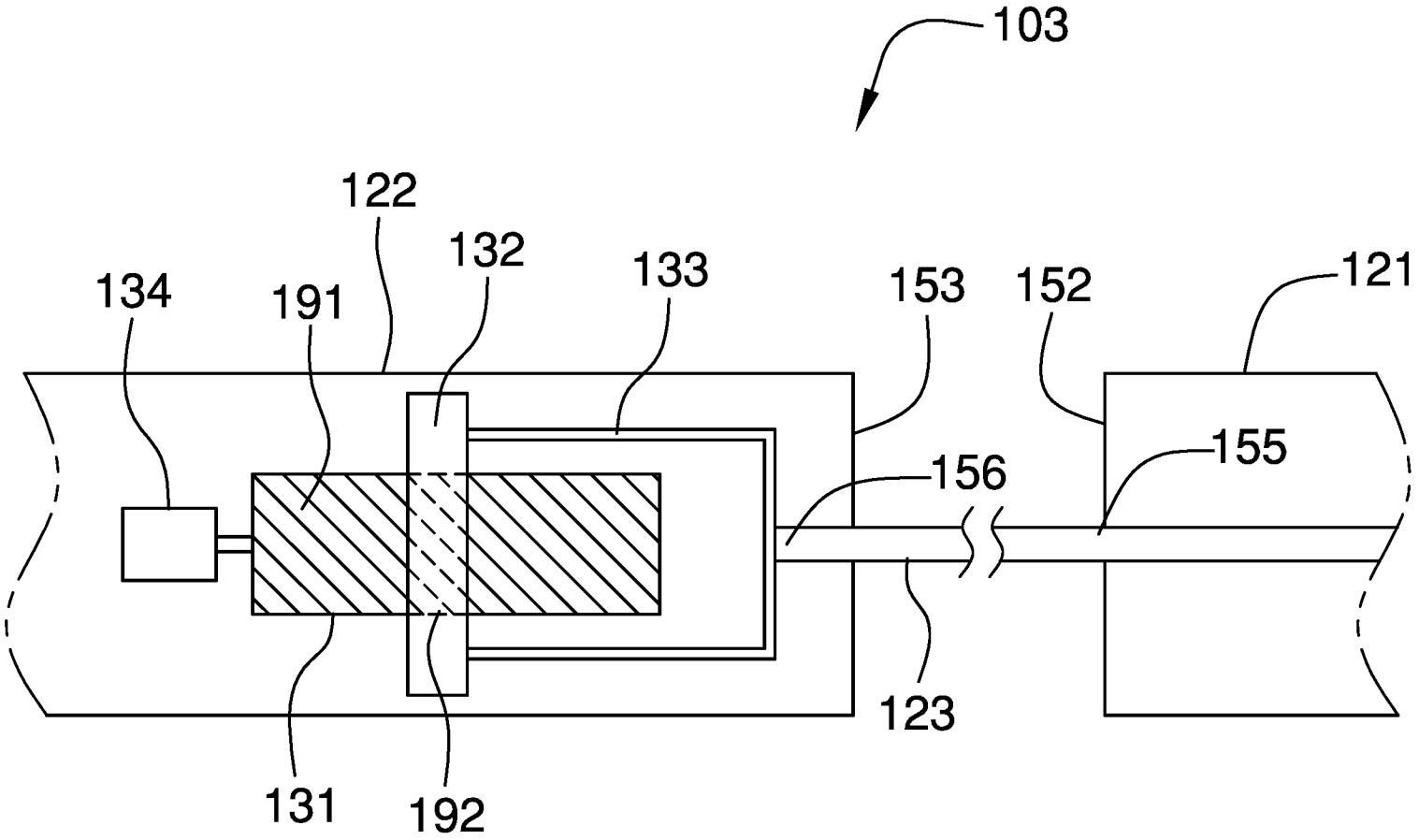
FIG. 7 is a detail view of an embodiment of the disclosure.

As shown most clearly in FIG. 7, the U grip 133 is a U shaped structure that attaches the transfer ring 132 to the sixth end 156 of the tenon 123 such that the rotation of the worm drive 131 is unhindered.

The motor 134 is an electrical motor that is used to rotate the worm drive 131. The battery 135 is a chemical device that is used to generate the electricity to operate the motor 134. The electrical ground 137 is a common reference voltage that is used throughout the control system 103.

Each of the plurality of switches 136 is a switch that is used to control the motor 134. The plurality of switches 136 are used to: 1) turn the invention 100 on and off; 2) initiate the rotation of the worm drive 131 in a first direction; and, 3) initiate the rotation of the worm drive 131 in a second direction wherein the second direction is opposite to the first direction.

The plurality of switches 136 comprises a first double pole single throw switch 141, a second double pole single throw switch 142, and a master switch 143. The first double pole single throw switch 141 is further defined with a first lead 161, a second lead 162, and a third lead 163. The second double pole single throw switch 142 is further defined with a fourth lead 164, a fifth lead 165, and a sixth lead 166. The master switch 143 is further defined with a seventh lead 167 and a eighth lead 168. The first double pole single throw switch 141 is a readily and commercially available electrical switch. The second double pole single throw switch 142 is a readily and commercially available electrical switch. The master switch 143 is a readily and commercially available electrical switch. The master switch 143 is a single pole single throw switch.

The first double pole single throw switch 141 rotates the motor 134. The second double pole single throw switch 142 rotates the motor 134 in a direction opposite to the operational direction of the first double pole single throw switch 141. The master switch 143 is an on-off switch.

The assembly of the control system 103 is described in this paragraph and the following paragraph. The anode 171 of the battery 135 (during discharge) is electrically connected to the electrical ground 137. The cathode 172 of the battery 135 (during discharge) is electrically connected to the seventh lead 167 of the master switch 143. The eighth lead 168 of the master switch 143 is electrically connected to the first lead 161 of the first double pole single throw switch 141.

The second lead 162 of the first double pole single throw switch 141 is electrically connected to the ninth lead 169 of the motor 134. The second lead 162 of the first double pole single throw switch 141 is electrically connected to the sixth lead 166 of the second double pole single throw switch 142. The third lead 163 of the first double pole single throw switch 141 is electrically connected to the fifth lead 165 of the second double pole single throw switch 142. The third lead 163 of the first double pole single throw switch 141 is electrically connected to the tenth lead 170 of the motor 134. The fourth lead 164 of the second double pole single throw switch 142 is electrically connected to the electrical ground 137.

In a second potential embodiment of the disclosure, the handle 102 further comprises a third arm 125, a detent 126, a first elastomeric covering 127, and a second elastomeric covering 128. The detent 126 is a mechanical device that connects and secures the third arm 125 to the second arm 122. The second arm 122 is formed as a hollow first prism that is further defined with an inner dimension. The third arm 125 is a second prism that is further defined with an outer dimension. The second arm 122 and the third arm 125 are geometrically similar. The outer dimension of the third arm 125 is less than the inner dimension of the second arm 122 such that the third arm 125 can be inserted into the second arm 122 in a telescopic manner. The third arm 125 inserts into the second arm 122 at the end of the second arm 122 that is distal from the first arm 121. The length of the handle 102 adjusts by adjusting the relative position of the third arm 125 within the second arm 122. The position of the third arm 125 relative to the second arm 122 is held in position using the detent 126. The detent 126 is selected from the group consisting of a cotter pin, a G snap collar, a cam lock collar, a threaded clutch, a split collar lock, or a spring loaded ball lock.

The first elastomeric covering 127 is an elastomeric material that covers the exterior lateral surfaces of the second arm 122. The first elastomeric covering 127 is formed with all apertures and form factors necessary to allow the first elastomeric covering 127 to accommodate the use and operation of the invention 100.

The second elastomeric covering 128 is an elastomeric material that covers the exterior lateral surfaces of the third arm 123. The second elastomeric covering 128 is formed with all apertures and form factors necessary to allow the second elastomeric covering 128 to accommodate the use and operation of the invention 100.

The following definitions were used in this disclosure:

Anodes and Cathodes: As used in this disclosure, an anode and a cathode are the connecting terminals of an electrical circuit element or device. Technically, the cathode is the terminal through which the physical electrons flow into the device. The anode is the terminal through which the physical electrons flow out of the device. As a practical matter the anode refers to: 1) the positive terminal of a power consuming electrical circuit element; 2) the negative terminal of a discharging battery or an electrical power source; and, 3) the positive terminal of a charging battery. As a further practical matter the cathode refers to: 1) the negative terminal of a power consuming electrical circuit element; 2) the positive terminal of a discharging battery or an electrical power source; and, 3) the negative terminal of a charging battery.

Battery: As used in this disclosure, a battery is a chemical device consisting of one or more cells, in which chemical energy is converted into electricity and used as a source of power.

Cavity: As used in this disclosure, a cavity is an empty space or negative space that is formed within an object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder. The center axis of a pyramid refers to a line formed through the apex of the pyramid that is perpendicular to the base of the pyramid. When the center axes of two cylinder or cylinder like structures share the same line they are said to be aligned. When the center axes of two cylinder like structures do not share the same line they are said to be offset.

Control System: As used in this disclosure, a control system is a first device or system that manages and regulates the behavior or operation of a second device or system.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Electric Motor: In this disclosure, an electric motor is a machine that converts electric energy into rotational mechanical energy.

Electrical Ground: As used in this disclosure, an electrical ground is a common reference voltage that is used in the design and implementation of electrical circuits. An electrical ground is often, but not necessarily, the discharge point of electric currents flowing through an electric circuit.

Exterior Screw Thread: An exterior screw thread is a ridge wrapped around the outer surface of a tube in the form of a helical structure that is used to convert rotational movement into linear movement.

Foraminous: As used in this disclosure, foraminous is an adjective that describes a surface, plate, or platform that is perforated with a plurality of holes.

Grip: As used in this disclosure, a grip is a covering that is placed over a hand hold, handle, or shaft.

Interior Screw Thread: An interior screw thread is a groove that is formed around the inner surface of a tube in the form of a helical structure that is used to convert rotational movement into linear movement.

Handle: As used in this disclosure, a handle is an object by which a tool, object, or door is held or manipulated with the hand.

Lead: As used in this disclosure, a lead is a conductor that is physically used to electrically connect an electrical component into a larger circuit assembly.

Lid: As used in this disclosure, a lid is a removable cover that is placed on a hollow structure to contain the contents within the hollow structure.

Motor: As used in this disclosure, a motor refers to the method of transferring energy from an external power source into mechanical energy.

Negative Space: As used in this disclosure, negative space is a method of defining an object through the use of open or empty space as the definition of the object itself, or, through the use of open or empty space to describe the boundaries of an object.

Nut: As used in this disclosure, a nut is a first object that is formed with a cylindrical negative space that further comprises an interior screw thread such that a second object with a matching exterior screw thread can screwed into the first object forming a threaded connection. A nut is further defined with an inner diameter.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance.

Rectangular Block: As used in this disclosure, a rectangular block refers to a three dimensional structure comprising six rectangular surfaces formed at right angles. Within this disclosure, a rectangular block may further comprise rounded edges and corners.

Screw: When used as a verb in this disclosure, to screw means: 1) to fasten or unfasten (unscrew) a threaded connection; or 2) to attach a helical structure to a solid structure.

Soap: As used in this disclosure, a soap is a cleansing chemical that is used in cleaning an object. A soap is generally formed from a mixture of one or more salts and one or more fatty acids.

Sponge: As used in this disclosure, a sponge is a material, generally with a fibrous structure, that is capable of absorbing and retaining liquids.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Telescopic: As used in this disclosure, telescopic is an adjective that describes an object made of sections that fit or slide into each other such that the object can be made longer or shorter by adjusting the relative positions of the sections.

Tenon: As used in this disclosure, a tenon is a structure that projects away from an edge a first object (often the end of a piece of wood). The tenon is sized and shaped to fit into a mortise that is formed in a second object such that the first object can be attached to the second object by inserting the tenon in the matching mortise.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

Worm Drive: As used in this disclosure, a worm drive refers to a mechanical arrangement where a rotating cylinder further comprising an exterior screw thread is used to: 1) rotate a gear; or 2) move a plate formed with an interior screw thread in a linear fashion in the direction of the center axis of the rotating cylinder. Worm drives are also referred to as worm gears.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hygiene device comprising:
a head, a handle, and a control system;
wherein the control system is installed in the handle;
wherein the head attaches to the handle;
wherein the hygiene device is configured for use in bathing;
wherein the hygiene device is configured for use with a soap;
wherein the hygiene device applies the soap during bathing activities;
wherein the head contains the soap;
wherein the hygiene device is further defined with a reach;
wherein the head is a cleansing structure;
wherein the head applies the soap during bathing;
wherein the control system adjusts the reach;
wherein the head comprises a plate, a first cavity, a second cavity, a sponge, a lid, and a foraminous divider;
wherein the plate is formed with a uniform dimension;
wherein the first cavity is a negative space that is formed in the plate;
wherein the lid is a barrier;
wherein the second cavity is a negative space that is formed in the plate;
wherein the sponge is a cleansing structure;
wherein the foraminous divider is a foraminous surface;
wherein the first cavity is formed in the shape of a rectangular block;
wherein the first cavity is sized to receive the soap;
wherein the lid encloses the first cavity;
wherein the second cavity is formed in the face of the plate that is distal from the face of the plate that received the first cavity;
wherein the second cavity receives the sponge.

2. The hygiene device according to claim 1
wherein the foraminous divider separates the first cavity from the second cavity;
wherein the foraminous divider allows water to pass between the first cavity and the second cavity such that the soap will be dispensed during the bathing process.

3. The hygiene device according to claim 2
wherein the handle comprises a first arm, a second arm, and a tenon;
wherein the tenon attaches the first arm to the second arm;
wherein the first arm is further defined with a first end and a second end;
wherein the second arm is further defined with a third end and a fourth end;
wherein the tenon is further defined with a fifth end and a sixth end.

4. The hygiene device according to claim 3 wherein the handle is adjustable in length.

5. The hygiene device according to claim 4
wherein the first arm is a shaft structure;
wherein the first arm attaches the second arm to the head;
wherein the head attaches to the first end of the first arm.

6. The hygiene device according to claim 5 wherein the second arm is a hollow shaft.

7. The hygiene device according to claim 6
wherein the tenon is a mechanical structure;

wherein the fifth end of the tenon attaches to the second end of the first arm;

wherein the sixth end of the tenon is inserted into the third end of the second arm.

8. The hygiene device according to claim 7 wherein the control system is an electromechanical device;

wherein the control system adjusts the span of the reach of the hygienic device;

wherein the control system is installed in the hollow second arm of the handle.

9. The hygiene device according to claim 8 wherein the control system comprises a worm drive, a transfer ring, a U grip, a motor, a battery, a plurality of switches, and an electrical ground;

wherein the motor and the transfer ring attach to the worm drive;

wherein the U grip attaches the transfer ring to the tenon;

wherein the motor, the plurality of switches, the battery, and the electrical ground are electrically interconnected;

wherein the motor is further defined with a ninth lead and an tenth lead;

wherein the battery is further defined with an anode and a cathode.

10. The hygiene device according to claim 9 wherein the worm drive is a cylindrical structure;

wherein the worm drive is formed with an exterior screw thread.

11. The hygiene device according to claim 10 wherein the transfer ring is a nut;

wherein the transfer ring is formed with an interior screw thread that matches the exterior screw thread of the worm drive;

wherein the transfer ring is screwed onto the worm drive in such a manner that the transfer ring will travel along the direction of the center axis of the worm drive when the worm drive is rotated around its center axis.

12. The hygiene device according to claim 11 wherein the U grip is a U shaped structure that attaches the transfer ring to the sixth end of the tenon such that the rotation of the worm drive is unhindered.

13. The hygiene device according to claim 12 wherein the motor is an electrical motor;

wherein the motor rotates the worm drive;

wherein the battery is a chemical device;

wherein the battery generates the electricity to operate the motor;

wherein the electrical ground is a common reference voltage;

wherein each of the plurality of switches is a switch that is used to control the motor.

14. The hygiene device according to claim 13 wherein the plurality of switches comprises a first double pole single throw switch, a second double pole single throw switch, and a master switch;

wherein the first double pole single throw switch is further defined with a first lead, a second lead, and a third lead;

wherein the second double pole single throw switch is further defined with a fourth lead, a fifth lead, and a sixth lead;

wherein the master switch is further defined with a seventh lead and a eighth lead;

wherein the first double pole single throw switch is a double pole single throw electrical switch;

wherein the second double pole single throw switch is a double pole single throw electrical switch;

wherein the master switch is a single pole single throw electrical switch.

15. The hygiene device according to claim 14 wherein the first double pole single throw switch rotates the motor;

wherein the second double pole single throw switch rotates the motor in a direction opposite to the operational direction of the first double pole single throw switch;

wherein the master switch is an on-off switch.

16. The hygiene device according to claim 15 wherein the anode of the battery during discharge is electrically connected to the electrical ground;

wherein the cathode of the battery during discharge is electrically connected to the seventh lead of the master switch;

wherein the eighth lead of the master switch is electrically connected to the first lead of the first double pole single throw switch;

wherein the second lead of the first double pole single throw switch is electrically connected to the ninth lead of the motor;

wherein the second lead of the first double pole single throw switch is electrically connected to the sixth lead of the second double pole single throw switch;

wherein the third lead of the first double pole single throw switch is electrically connected to the fifth lead of the second double pole single throw switch;

wherein the third lead of the first double pole single throw switch is electrically connected to the tenth lead of the motor;

wherein the fourth lead of the second double pole single throw switch is electrically connected to the electrical ground.

* * * * *